US008947306B2

(12) United States Patent
Tanaka et al.

(10) Patent No.: US 8,947,306 B2
(45) Date of Patent: Feb. 3, 2015

(54) GLASS ANTENNA

(75) Inventors: Kosuke Tanaka, Tokyo (JP); Hideaki Oshima, Tokyo (JP); Hidetoshi Oka, Tokyo (JP)

(73) Assignee: Nippon Sheet Glass Company, Ltd. (JP)

( * ) Notice: Subject to any disclaimer, the term of this patent is extended or adjusted under 35 U.S.C. 154(b) by 187 days.

(21) Appl. No.: 13/637,074

(22) PCT Filed: Jan. 21, 2011

(86) PCT No.: PCT/JP2011/051057

§ 371 (c)(1), (2), (4) Date: Sep. 25, 2012

(87) PCT Pub. No.: WO2011/122074

PCT Pub. Date: Oct. 6, 2011

(65) Prior Publication Data

US 2013/0027257 A1 Jan. 31, 2013

(30) Foreign Application Priority Data

Mar. 30, 2010 (JP) ..... 2010-079657

(51) Int. Cl.
*H01Q 1/32* (2006.01)
*H01Q 1/12* (2006.01)

(52) U.S. Cl.
CPC ..... *H01Q 1/1271* (2013.01)
USPC ..... 343/713

(58) Field of Classification Search
CPC ..... H01Q 1/1271; H01Q 1/32
USPC ..... 343/713
See application file for complete search history.

(56) References Cited

U.S. PATENT DOCUMENTS

| | | | | |
|---|---|---|---|---|
| 5,959,586 | A | 9/1999 | Benham et al. | 343/713 |
| 6,369,767 | B1 * | 4/2002 | Oka et al. | 343/713 |
| 6,822,613 | B2 * | 11/2004 | Kubota | 343/713 |
| 7,859,472 | B2 * | 12/2010 | Tsurume | 343/713 |

FOREIGN PATENT DOCUMENTS

| | | |
|---|---|---|
| JP | 09 284025 | 10/1997 |
| JP | 10 513329 | 12/1998 |
| JP | 2001 136013 | 5/2001 |
| JP | 2009 065359 | 3/2003 |
| JP | 2007 028213 | 2/2007 |
| JP | 2007 295051 | 11/2007 |

* cited by examiner

*Primary Examiner* — Hoang V Nguyen
(74) *Attorney, Agent, or Firm* — Adams & Wilks

(57) ABSTRACT

A glass antenna is installed on a glass having a first edge and a second edge opposite the first edge. A first antenna element extends linearly in a direction from the first edge to the second edge of the glass. A second antenna element extends in a direction opposite to the direction of the first antenna and is connected to a grounding point provided on the first edge of the glass. At least one third antenna element extends along the circumference of the glass and intersects one of a tip of the first antenna element and a base of the second antenna element.

16 Claims, 10 Drawing Sheets

(a)

(b)

(a)

(b)

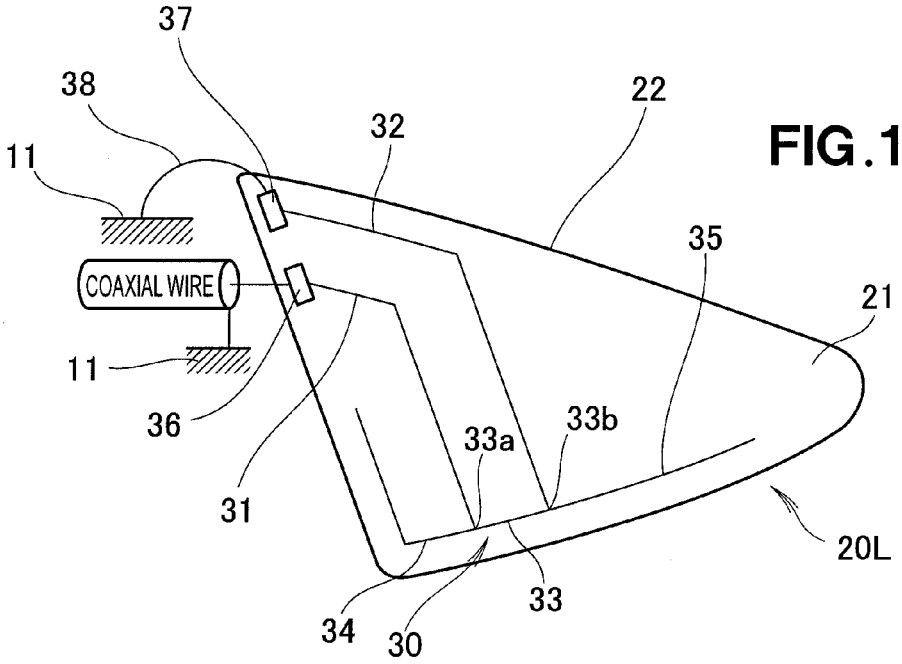
FIG.10
FIG.11
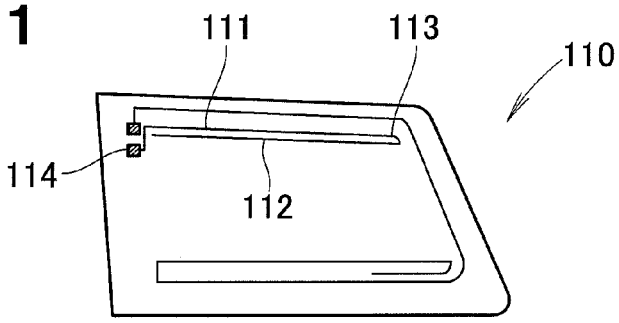
FIG.12
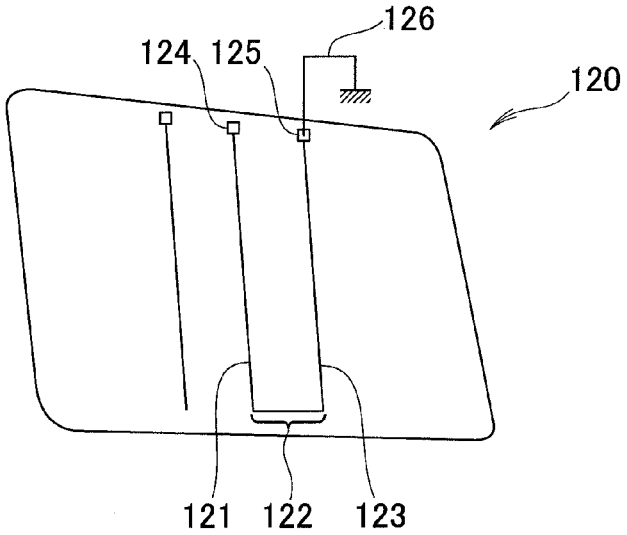

GLASS ANTENNA

CROSS-REFERENCE TO RELATED APPLICATIONS

This application is a U.S. national stage application of International Application No. PCT/JP2011/051057 filed Jan. 21, 2011, claiming a priority date of Mar. 30, 2010, and published in a non-English language.

BACKGROUND OF THE INVENTION

1. Technical Field

The present invention relates to a glass antenna provided on a glass in an opening in a vehicle body.

2. Background Art

Glass antennas are widely used because the antennas have superior designs, reduced damage concerns, less wind noise, and other reasons unlike conventional rod antennas. A glass antenna used on a window glass is well-known, as disclosed in Patent Literature 1 below. FIG. 11 shows the glass antenna disclosed in Patent Literature 1.

FIG. 11 hereof shows a space-saving monopole glass antenna 110 having an increased reception gain across a wide range from FM radio broadcast waves to TV broadcast waves and UHF broadcast waves. The antenna 110 includes a horizontal strip 111, a horizontal strip 112 and a fold 113 interconnecting the strips 111, 112. The horizontal strip 111 extends substantially horizontally from a feed point 114. The horizontal strip 112 is substantially parallel to the horizontal strip 111.

Among known glass antennas is a grounded glass antenna as disclosed in Patent Literature 2 below. The grounded glass antenna disclosed in Patent Literature 2 has an impedance designed to approximate to a characteristic impedance of a feeder line of the antenna without use of an impedance matching circuit. FIG. 12 hereof shows the glass antenna disclosed in Patent Literature 2.

In FIG. 12, the glass antenna 120 includes an antenna pattern including a substantially linearly extending first element 121 and a second element 123 extending in substantially parallel to the first element 121. The antenna pattern also includes a folded portion 122 interconnecting the first element 121 and the second element 122. The glass antenna 120 further includes a feed point 124 connected to a distal end of the first element 121, a ground point 125 connected to a distal end of the second element 123, and a connecting wire 126 for grounding the ground point 125 to a vehicle body.

However, it is difficult to design the glass antennas disclosed in Patent Literatures 1 and 2 to provide a desired resonance frequency for improving reception capability when the glass antennas are mounted on glasses in vehicle windows having small opening areas of, for example, less than 0.15 $m^2$. This is because the opening areas of the vehicle windows are so small that the antenna element cannot be long enough to allow addition of a bypass pattern. Recently, a vehicle quarter window to which is attached an antenna has been required to have a reduced surface area if the quarter window is used in, particularly, so-called mini-vans, sport utility vehicles (SUVs), and the like.

A glass antenna designed to be mounted on a glass having a small surface area is known as disclosed in, for example, Patent Literature 3 below. FIG. 13 hereof shows the glass antenna disclosed in Patent Literature 3.

In FIG. 13, the glass antenna 130 disclosed in Patent Literature 3 includes a single feeder terminal 131 connected to a receiver, first and second ground terminals 132, 133 connected to electrical conductors 140 in an opening in a glass window of a vehicle, and a single antenna element including conductive elements 134, 135, 136 connected to the feeder terminal 131 and the first and second ground terminals 132, 133.

In the antenna disclosed in Patent Literature 3, the addition of the ground terminals minimizes decrease in antenna impedance, and thus the glass antenna can provide adequate reception capability even when attached to a small glass window.

However, the antenna disclosed in Patent Literature 3 has a large number of terminals, the feeder terminal 131 and ground terminals 132, 133, etc. attached to the glass surface, as well as a large number of feeder lines. Material cost and assembly work are therefore created, resulting in a cost increase.

There has been a demand for a glass antenna providing improved reception capability without requiring an increased cost even when the glass antenna is installed in a small opening of a glass window.

PRIOR ART LITERATURE

Patent Literature

Patent Literature 1: JP-A-9-284025
Patent Literature 2: JP-A-2001-136013
Patent Literature 3: JP-A-2009-65359

SUMMARY OF INVENTION

An object of the present invention is to provide a glass antenna providing improved reception capability without requiring an increased cost even when installed in a small opening of a glass window.

According to one aspect of the present invention, there is provided a glass antenna installed on a glass attached to an opening portion of a vehicle body, the glass having a first edge and a second edge opposite the first edge, the glass antenna including antenna elements comprising: a first antenna element extending linearly from a feed point provided at the first edge of the glass toward the second edge of the glass; a second antenna element folded and connected to a distal end of the first antenna element, the second antenna element extending in a direction opposite to a direction of extension of the first antenna element, the second antenna element being connected to a ground point provided on the first edge of the glass; and at least one third antenna element extending along the opening portion of the vehicle body to at least one of the distal end of the first antenna element and a proximal end of the second antenna element.

Since the glass antenna includes the third antenna element in addition to the first and second antenna elements, the apparent antenna element length can therefore be larger. Due to the apparently larger length antenna element length, resonance can be obtained at the desired frequency even when the glass antenna is installed on a glass in a small opening area. In addition, only one ground point is required to be attached to the glass, which contributes to cost reduction.

Elongation of the antenna element length makes the antenna impedance so higher than that of an ordinary monopole antenna that the antenna impedance approximates to the characteristic impedance of a feeder line, which improves reception capability of the glass antenna. This means that the glass antenna of the present invention exhibits improved reception capability without requiring increases cost even when the glass antenna is installed on the window glass of small area.

Preferably, the first antenna element and the second antenna element extend in correspondence to a plane of polarization of a radio wave to be received. The glass antenna can thus receive horizontally polarized radio waves or vertically polarized radio waves.

Preferably, the at least one third antenna element is spaced from the second edge of the glass by an interval of 50 mm or less. The present inventors have found that provision of the third antenna element extending along the edge of the glass with the interval of 50 mm between the third antenna element and the edge of the glass makes the antenna pattern apparently longer. This results in improved reception capability of the glass antenna.

Preferably, a ratio of a length of at least one third antenna element to a length of each of the first antenna element and the second antenna element is 1.0 or less. This ratio allows the glass antenna to be designed to provide improved reception capability.

Preferably, the at least one third antenna element includes a first antenna section extending away from the second antenna element and a second antenna section extending away from the first antenna element, and the antenna elements further comprising: a first bypass antenna element branching off from an end portion of the first antenna section and extending to the feed point; and a second bypass antenna element branching off from an end portion of the second antenna section and extending to the ground point.

This means that addition of a bypass pattern to the antenna elements of the glass antenna is possible even when the glass antenna is attached to a small surface area. Further, reception capability of the glass antenna can be improved because the antenna can resonate even at a low frequency.

BRIEF DESCRIPTION OF DRAWINGS

FIG. 10 is a view of a further modification to the glass antenna of FIG. 2 in the embodiment;

FIG. 11 is a view of a structure of a glass antenna in a first conventional example;

FIG. 12 is a view of a structure of a glass antenna in a second conventional example.

DETAILED DESCRIPTION OF THE INVENTION EMBODIMENTS

The preferred embodiments of the present invention are described below with reference to the accompanying drawings.

Embodiment

A glass antenna according to one embodiment of the present invention can be attached to, for example, a quarter window of a vehicle.

Figure 1:
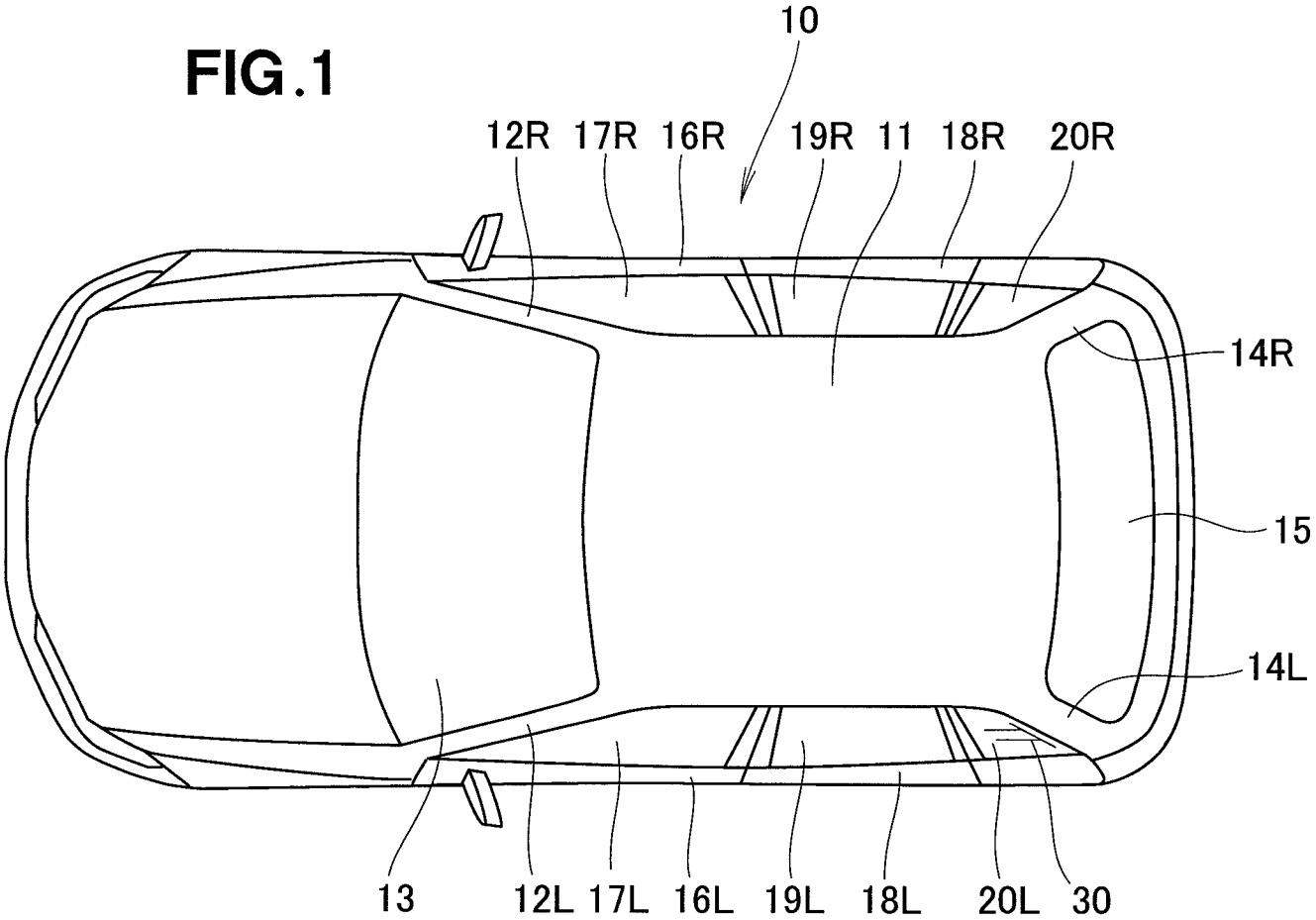
FIG. 1 is a plan view of a vehicle having an attached glass antenna in an embodiment of the present invention.

As shown in FIG. 1, a glass window of a vehicle 10 includes a windshield 13 fitted between left and right pillars 12L, 12R of a vehicle body 11 and a rear window 15 fitted between left and right rear pillars 14L, 14R. The glass window further includes left and right front side windows 17L, 17R vertically movably attached to left and right front doors 16L, 16R, and left and right rear side windows 19L, 19R vertically movably attached to left and right rear doors 18L, 18R. The glass window further includes left and right quarter windows 20L, 20R fixed to the vehicle body 11.

A glass antenna 30 in the embodiment is attached to the left quarter window 20L. The glass antenna 30 is designed to receive mainly radio waves in an FM broadcast band.

The quarter window 20L will be described in detail with reference to FIG. 2. The quarter window 20L includes a quarter glass 21 provided with the glass antenna 30.

The glass antenna 30 is disposed on an area defined by a circumference 22 of the quarter glass 21. The glass antenna 30 includes antenna elements including a first antenna element 31, a second antenna element 32 provided with a fold 33, and third antenna elements 34, 35.

The first antenna element 31 extends in a straight line from a feed point 36 provided at one edge (near a body flange) of the quarter glass 21 toward an opposite edge of the quarter glass 21. The second antenna element 32 is folded back and connected to a distal end of the first antenna element 31. The second antenna element 32 extends in a direction of extension of the first antenna element 31. The second antenna element 32 is connected to a ground point 37 provided on the one edge of the quarter glass 21. The ground point 37 is connected to a conductor (vehicle body 11) via a connecting wire 38.

The third antenna elements 34, 35 extend to a distal end (tip) 33*a* of the first antenna element 31 and a proximal end (base) 33*b* of the second antenna element 32, respectively, along an opening portion of the vehicle body 11. In other words, the glass antenna 30 of the present invention is featured primarily by the third antenna elements 34, 35 extending along the circumference 22 of the quarter glass 21.

The glass antenna 30 has an impedance higher than that of a grounded glass antenna, and the impedance of the glass antenna 30 approximates to a characteristic impedance of a feeder line. In addition, the third antenna elements 34, 35 extend along the circumference 22 of the quarter glass 21, whereby the apparent antenna pattern is longer, and the glass antenna 30 provides a desired resonance frequency in spite of being installed on the quarter windows 20L, 20R of small opening area.

The glass antenna 30 will be discussed in detail below. The glass antenna 30 has a resonance frequency lower than a resonance frequency of a glass antenna 120 shown in FIG. 12 because the glass antenna 30 includes the third antenna elements 34, 35 in addition to the first and second antenna elements 31, 32 corresponding to first and second elements 121, 122, respectively. The third antenna elements 34, 35 extending along the circumference 22 of the quarter glass 21 provide more advantage than if the third antenna elements 34, 35 did not extend along the circumference 22 of the quarter glass 21.

Figure 3:
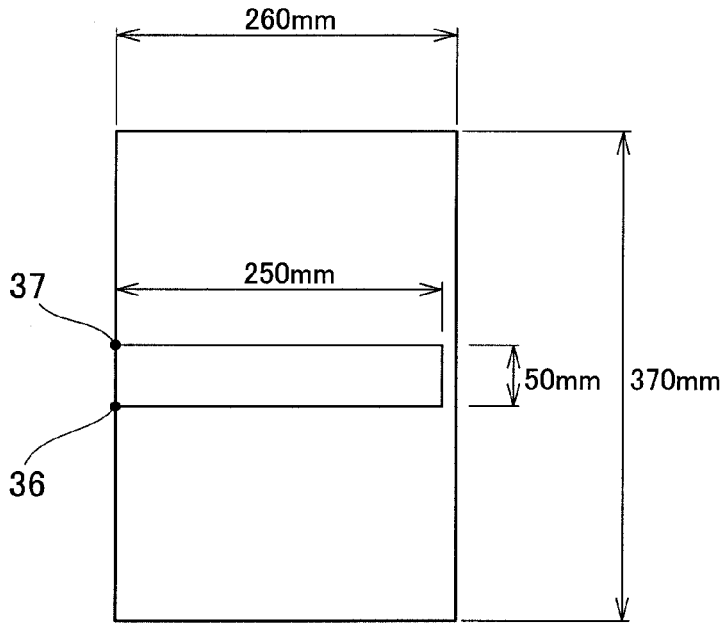
FIG. 3 is a schematic view of the glass antenna in the embodiment.
Figure 3:
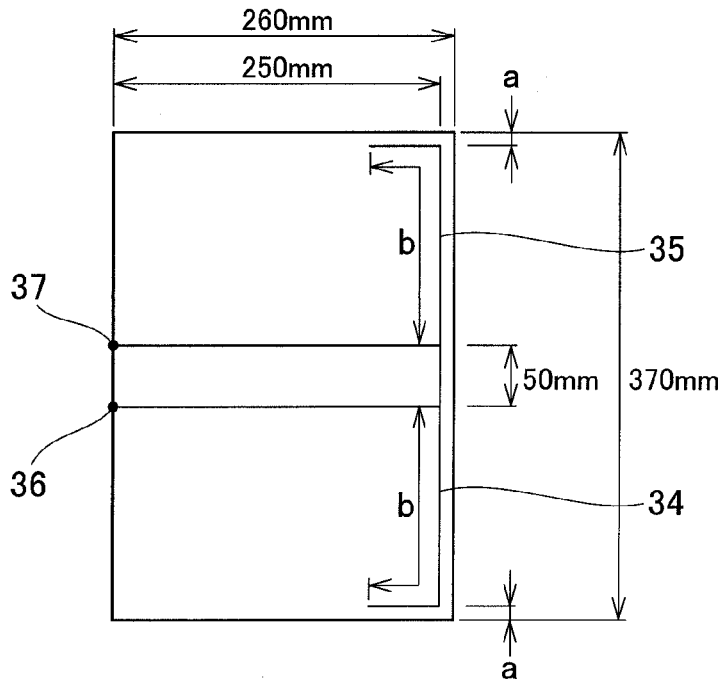

In order to prove the advantage provided by the third antenna elements 34, 35 of the glass antenna 30, the present inventors designed the grounded glass antenna shown in FIG. 3(*a*) and carried out a simulation. More specifically, the first element and the second element each having a length of 250 mm were installed on a glass having dimensions of 370 mm by 260 mm and having a comparatively narrow opening and an interval between the first element and the second element was set to be 50 mm. It was found that the grounded glass antenna provided a resonance frequency of 145 MHz.

The present inventors furthermore added the third antenna elements 34, 35 to the glass antenna of FIG. 3(*a*), as shown in FIG. 3(*b*), and evaluated resonance frequencies when a length "b" of each of third antenna elements 34, 35 and an interval "a" between each of the third antenna elements 34, 35 and the circumference 22 of the quarter glass 21 were varied. As a result, the resonance frequencies were shown in Tables 1 and 2 as well as in a graph of FIGS. 4(*a*) and 4(*b*).

TABLE 1

| a [mm] | b [mm] | Resonance Frequency [MHz] |
|---|---|---|
| 10 | 0 | 145.0 |
| | 170 | 85.2 |
| | 200 | 80.4 |
| | 230 | 76.1 |
| | 250 | 75.0 |
| | 270 | 74.5 |
| 20 | 0 | 145.0 |
| | 170 | 94.0 |
| | 200 | 88.9 |
| | 230 | 84.4 |
| | 250 | 82.0 |
| | 270 | 81.0 |
| 30 | 0 | 145.0 |
| | 170 | 98.7 |
| | 200 | 93.6 |
| | 230 | 89.0 |
| | 250 | 87.0 |
| | 270 | 86.0 |

TABLE 2

| a [mm] | b [mm] | Resonance Frequency [MHz] |
|---|---|---|
| 40 | 0 | 145.0 |
| | 170 | 101.3 |
| | 200 | 96.3 |
| | 230 | 91.7 |
| | 250 | 89.0 |
| | 270 | 88.0 |
| 50 | 0 | 145.0 |
| | 170 | 103.1 |
| | 200 | 98.2 |
| | 230 | 93.6 |
| | 250 | 91.0 |
| | 270 | 90.0 |
| 60 | 0 | 145.0 |
| | 170 | 104.0 |
| | 200 | 99.0 |
| | 230 | 94.0 |
| | 250 | 92.0 |
| | 270 | 91.0 |

Tables 1 and 2 indicate how the resonance frequency relates to the interval "a" and the length "b". In Tables 1 and 2, it is shown that the resonance frequency (MHz) varies with the interval "a" and the length "b". For example, the resonance frequency is 145 MHz when the interval "a" is 10 mm and the length "b" is 0, and the resonance frequency is lowered as the length "b" increases.

Figure 4:
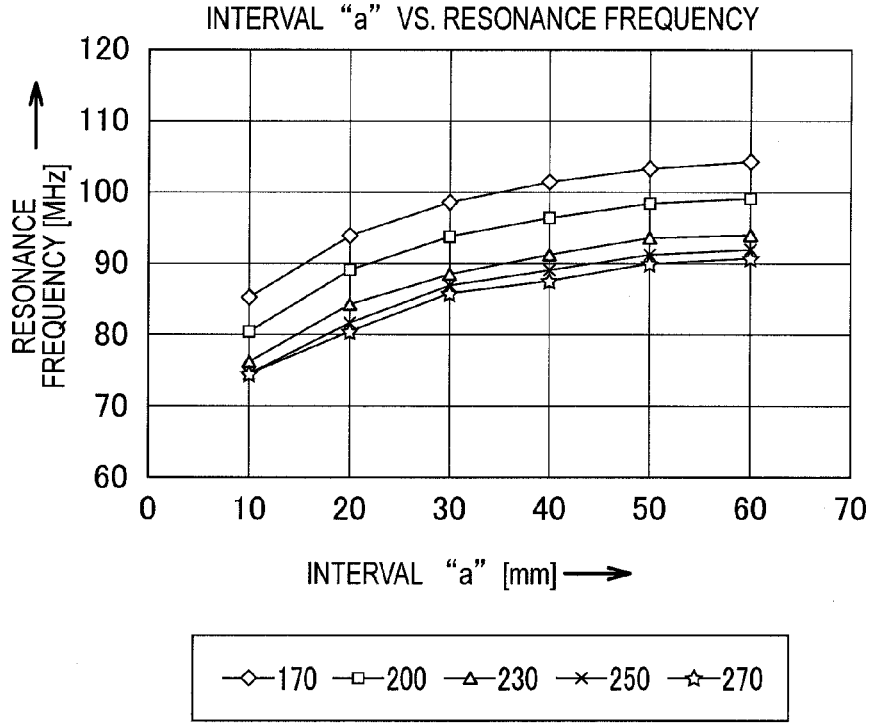
FIG. 4 is a graph of the results of evaluation based on a simulation of the glass antenna in the embodiment.
Figure 4:
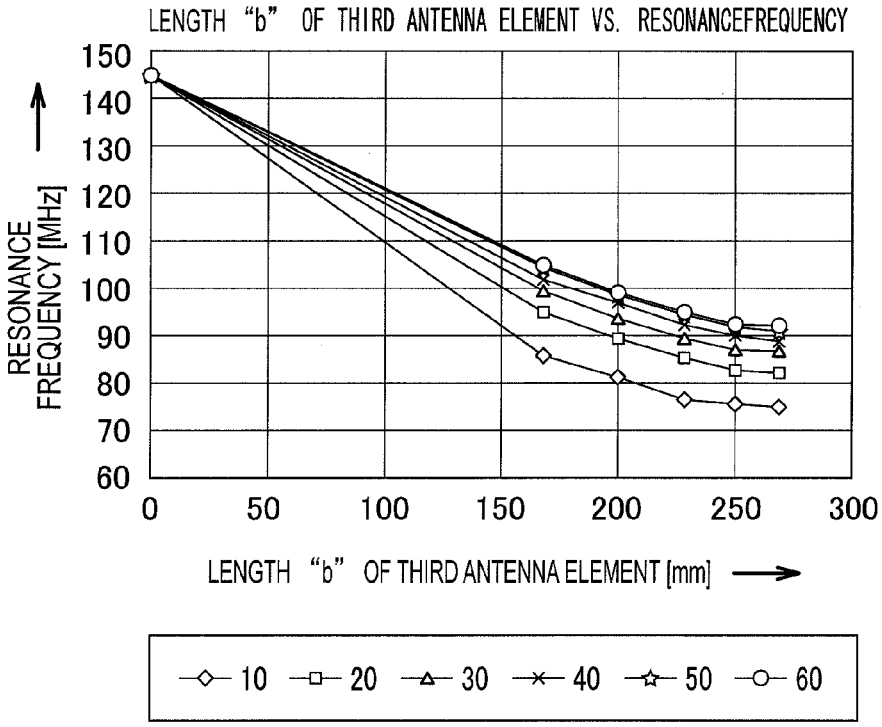

The graph in FIG. 4(*a*) shows the relationship between the interval "a" (*mm*) and the resonance frequency (MHz) when the antenna element length "b" is a constant (170, 200, 230, 250, 270 mm). The graph in FIG. 4(*b*) shows the relationship between the antenna element length "b" (*mm*) and the resonance frequency (MHz) when the interval "a" is a constant (10, 20, 30, 40, 50, 60 mm).

As can be seen from Tables 1 and 2, the provision of the third antenna elements 34, 35 provides the resonance frequency lower than 145 MHz. As shown in the graph of FIG. 4(*a*), further, the resonance frequency is lowered as the interval "a" becomes small. In particular, it has turned out that the interval "a" less than or equal to 50 mm provides more advantageous results. As shown in the graph of FIG. 4(*b*) and Table 1, furthermore, the resonance frequency is lowered as the length "b" of each of the third antenna elements 34, 35 becomes large. In particular, it has been found that the length "b" less than or equal to 250 mm provides more advantageous results.

Description will now be made as to relationship between the length of each of the first and second antenna elements 31, 32 and the length of each of the third antenna elements 34, 35. A ratio of the length of each of the third antenna elements 34, 35 to the length of each of the first and second antenna elements 31, 32 is designated at "c". The relationship between the ratio "c" and the resonance frequency was examined. The examination results are shown in Tables 3 and 4.

TABLE 3

| a [mm] | c = b/a [mm] | Resonance Frequency [MHz] |
|---|---|---|
| 10 | 0.00 | 0 |
| | 0.68 | −41 |
| | 0.80 | −45 |
| | 0.92 | −48 |
| | 1.00 | −48 |
| | 1.08 | −49 |
| 20 | 0.00 | 0 |
| | 0.68 | −35 |
| | 0.80 | −39 |
| | 0.92 | −42 |
| | 1.00 | −43 |
| | 1.08 | −44 |
| 30 | 0.00 | 0 |
| | 0.68 | −32 |
| | 0.80 | −35 |
| | 0.92 | −39 |
| | 1.00 | −40 |
| | 1.08 | −41 |

TABLE 4

| a [mm] | c = b/a [mm] | Resonance Frequency [MHz] |
|---|---|---|
| 40 | 0.00 | 0 |
| | 0.68 | −30 |
| | 0.80 | −34 |
| | 0.92 | −37 |
| | 1.00 | −39 |
| | 1.08 | −39 |
| 50 | 0.00 | 0 |
| | 0.68 | −29 |
| | 0.80 | −32 |

TABLE 4-continued

| a [mm] | c = b/a [mm] | Resonance Frequency [MHz] |
|---|---|---|
| | 0.92 | −35 |
| | 1.00 | −37 |
| | 1.08 | −38 |
| 60 | 0.00 | 0 |
| | 0.68 | −28 |
| | 0.80 | −32 |
| | 0.92 | −35 |
| | 1.00 | −37 |
| | 1.08 | −37 |

In Tables 3 and 4, for example, the measured resonance frequency was −41 MHz when the interval "a" is 10 mm and the ratio "c" of the length of each of the third antenna elements 34, 35 to each of the first and second antenna elements 31, 32 is 0.68. The resonance frequency is lowered as the ratio "c" increases from 0.68.

As is clear from Tables 3 and 4, the glass antenna 30 in the embodiment provides more advantageous results when the interval "a" is less than or equal to 50 mm and the ratio "c" is less than or equal to 1.0. That is, the resonance frequency of the glass antenna 30 is about 30 to 50% lower than if the glass antenna 30 did not include the third antenna elements 34, 35.

Figure 5:
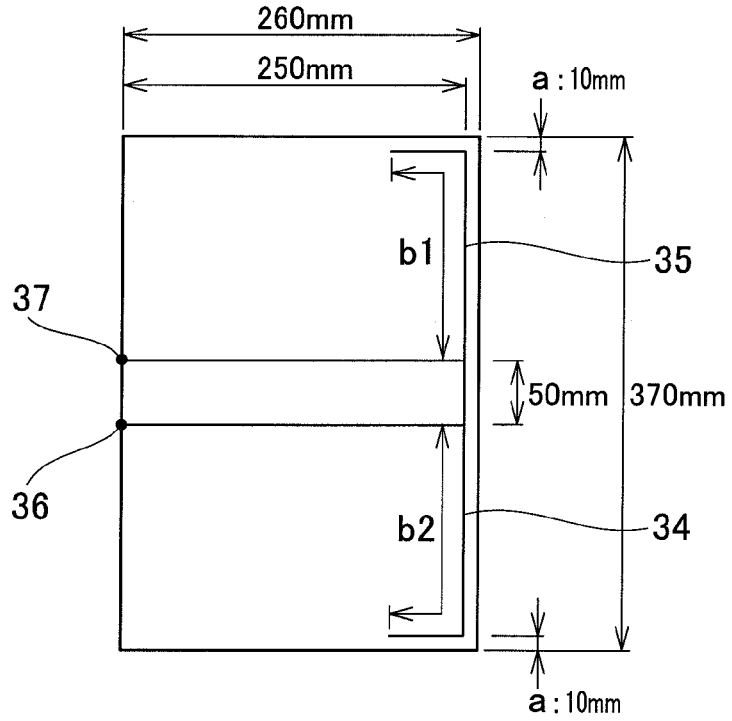
FIG. 5 is a view of an example of a dimension of each antenna element of the glass antenna in the embodiment.

The present inventors then performed a simulation under conditions shown below for variation in the resonance frequency when the lengths b1, b2 of the third antenna elements 34, 35 shown in FIG. 5 are varied, and verified the results. More specifically, the sum of the lengths b1, b2 of the two third antenna elements 34, 35 was 370 mm and the resonance frequency measured when the lengths b1 and b2 are varied are shown in Table 5.

TABLE 5

| Lengths of two third antenna elements and resonance frequency | | | | | | | | | |
|---|---|---|---|---|---|---|---|---|---|
| b1[mm] | 190 | 165 | 140 | 115 | 90 | 95 | 40 | 15 | 0 |
| b2[mm] | 190 | 215 | 240 | 265 | 290 | 315 | 340 | 365 | 380 |
| Resonance Frequency [MHz] | 81.9 | 81.7 | 81.2 | 80.6 | 79.6 | 78.3 | 76.8 | 75.1 | 73.9 |

In Table 5, the resonance frequency is 81.9 MHz when, for example, the lengths b1 and b2 are the same (the lengths b1, b2 are both 190 mm). The resonance frequency is 91.7 MHz when b1 is 165 mm and b2 is 215 mm. In Table 5, the resonance frequency when the lengths of the two third antenna elements 34, 35 are the same is the highest. The different lengths b1, b2 or use only one of the third antenna elements 34, 35 provides advantageous results. Accordingly, a lower resonance frequency can be provided even when limitations on positions of antenna terminals require use of the two third antenna elements 34, 35 of different lengths or only one of the third antenna elements 34, 35.

The present inventors furthermore designed a glass antenna 30 in accordance with the present invention, and mounted the glass antenna 30 on a vehicle window glass. Then, radio waves radiated from one direction to the vehicle while the vehicle rotated through 360° in a horizontal plane within an anechoic chamber, and measures reception sensitivity of the glass antenna for all angular positions of the vehicle.

Figure 6:
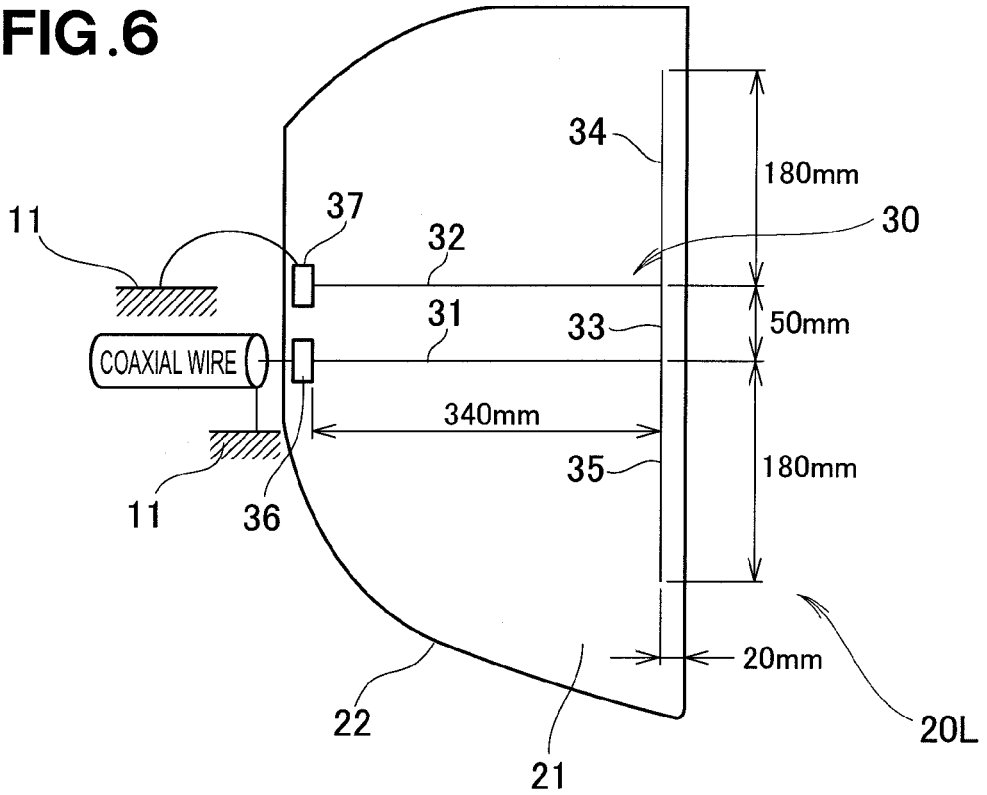
FIG. 6 is a view of another example of the dimension of each antenna element of the glass antenna in the embodiment.

Dimensions of the glass antenna 30 are shown in FIG. 6. More specifically, the length of the first antenna element 31 was 340 mm, the length of the second antenna element 32 was 240 mm, the length of the fold 33 was 50 mm, the length of each of the third antenna elements 34, 35 was 180 mm, and the interval between each of the third antenna elements 34, 35 and the opening portion 50 (body flange) was 20 mm.

Figure 7:
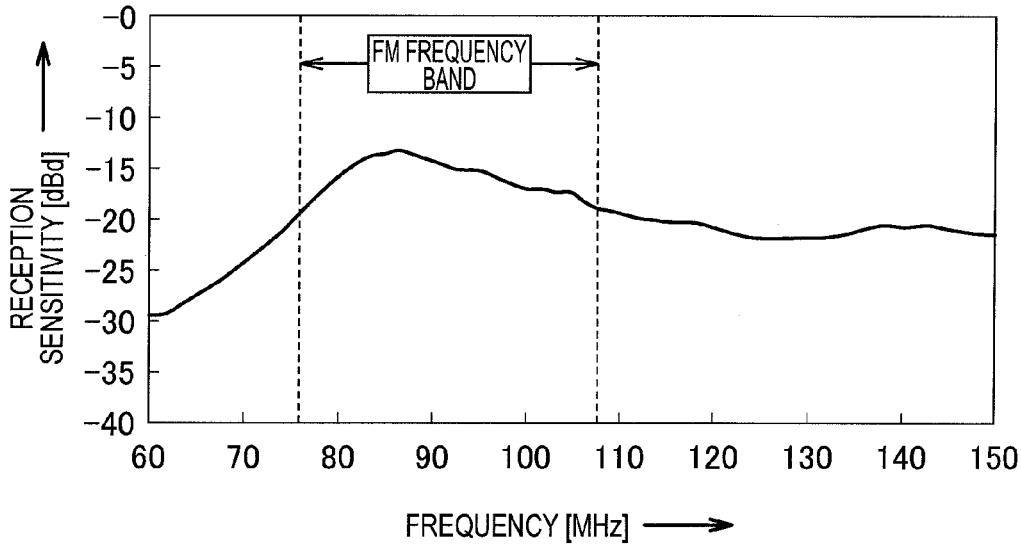
FIG. 7 is a graph showing reception sensitivity of the glass antenna shown in FIG. 6 when the glass antenna receives a horizontally polarized wave within a domestic broadcast frequency band.

The measured reception sensitivity of the glass antenna 30 is shown in the graph in FIG. 7. As is clear from the graph of FIG. 7, the reception sensitivity of the glass antenna 30 of the present embodiment has a peak at a frequency within a FM broadcast band (76 to 108 MHz). It is noted that the reception sensitivity shown in FIG. 7 is a reception sensitivity when the glass antenna 30 is disposed in correspondence to a horizontal polarization.

Figure 8:
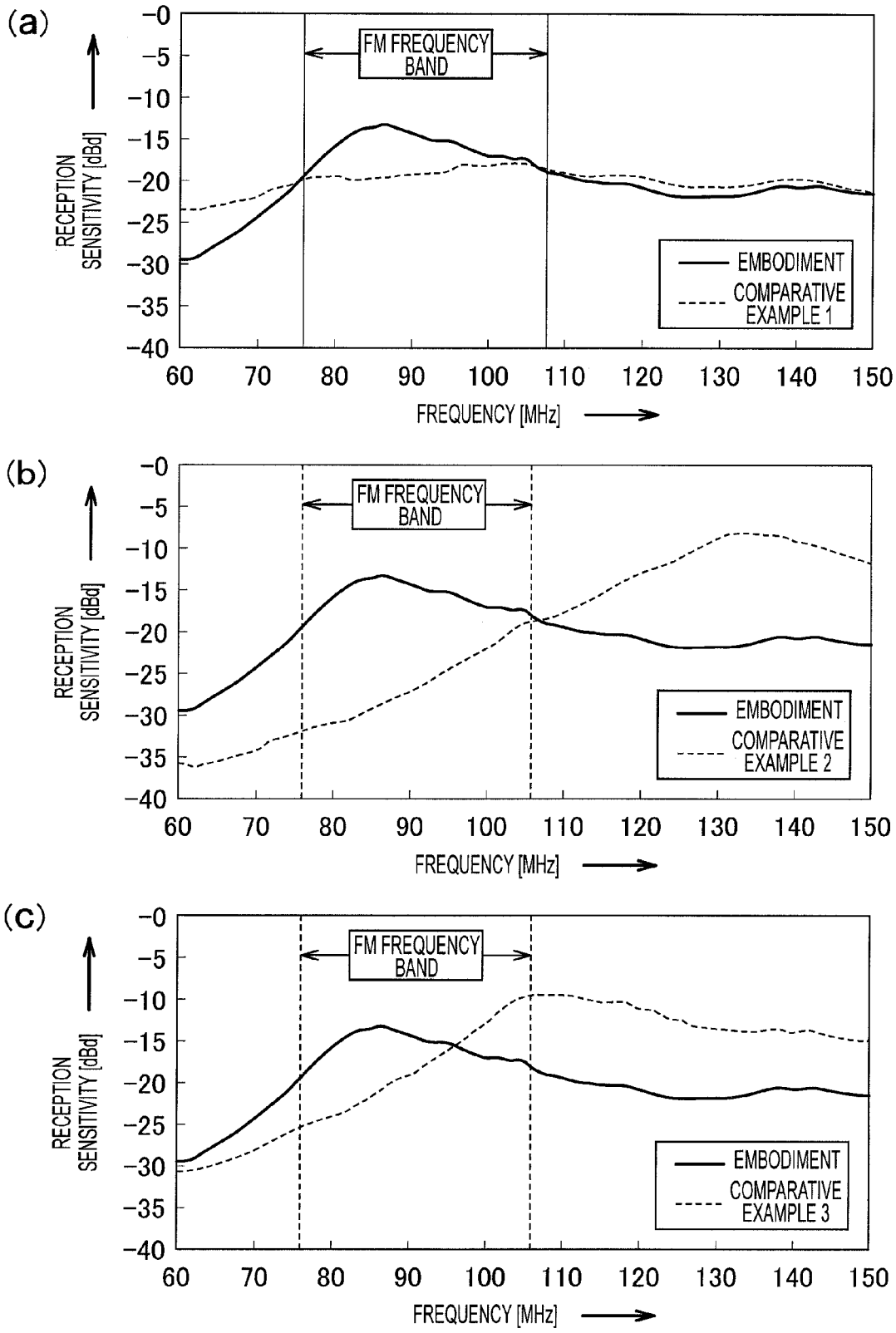
FIG. 8 is a view showing reception sensitivity of each of glass antennas in three comparative examples and the reception sensitivity of the glass antenna shown in FIG. 6 when the glass antennas in the comparative examples and the glass antenna of FIG. 6 receive the horizontally polarized wave within the domestic broadcast frequency band.

Next, a monopole antenna pattern was designed and mounted on a vehicle window glass. Then, radio waves radiated from one direction to the vehicle while the vehicle rotated 360° in a horizontal plane within an anechoic chamber, and measurements of reception sensitivity of the monopole antenna pattern for all angular positions of the vehicle were taken. FIG. 8(*a*) graphically shows the reception sensitivity of the monopole antenna pattern as "comparative example 1", and the reception sensitivity of the glass antenna 30 of FIG. 2 as "embodiment".

A graph of FIG. 8(*a*) indicates that the monopole antenna pattern provides no effective reception sensitivity. The failure to provide no effective reception sensitivity results from a lack of impedance matching.

Next, a grounded antenna pattern was designed and mounted on a vehicle window glass. Then, radio waves radiated from one direction to the vehicle while the vehicle rotated 360° in a horizontal plane within an anechoic chamber, and measurements of reception sensitivity of the grounded antenna pattern for all angular positions of the vehicle were taken. FIG. 8(*b*) graphically shows the reception sensitivity of the grounded antenna pattern as "comparative example 2", and the reception sensitivity of the glass antenna 30 of FIG. 2 as "embodiment".

From a graph of FIG. 8(*b*), it is found that the grounded antenna pattern does not provide sufficient reception sensitivity within the FM broadcast band when an opening area of the window is small. The grounded antenna has an impedance matching an impedance of a feeder line in an attempt to improve the reception sensitivity; however, the peak of the reception sensitivity does not lie at a frequency within the FM broadcast band. The failure to provide the peak of the reception sensitivity at the frequency within the FM broadcast band results from the apparent shortness of the grounded antenna pattern.

Finally, a grounded antenna pattern with a bypass antenna added in an attempt to improve reception sensitivity was designed and mounted on a vehicle window glass, and then, as discussed above, radio waves radiated from one direction to the vehicle as the vehicle rotated 360° in a horizontal plane within an anechoic chamber, and measurements of the reception sensitivity at all angular positions of the vehicle were taken. FIG. 8(*c*) graphically shows the reception sensitivity of the grounded antenna pattern with the bypass antenna as "comparative example 3", and the reception sensitivity of the glass antenna 30 of FIG. 2 as "embodiment".

From a graph of FIG. 8(*c*), it turns out that the grounded antenna pattern with the bypass antenna added does not provide sufficient reception sensitivity within the FM broadcast band when the opening area of the window is small. The grounded antenna pattern has an impedance matching an impedance of a feeder line and apparently widens in an attempt to improve reception sensitivity; however, the peak of reception sensitivity does not lie at a frequency within the FM broadcast band because of the apparent shortness of the antenna pattern.

By contrast, the glass antenna 30 in the embodiment of the present invention has the apparently large antenna element length and therefore provides resonance at a desired frequency in spite of being mounted on the glass in the window of small opening area. As a result, the peak of the reception sensitivity of the glass antenna 30 lies at a frequency within the FM broadcast band (76 to 108 MHz), as shown in FIGS. 8(*a*), 8(*b*), and 8(*c*). In addition, the glass antenna 30 has an antenna impedance greater than that of an ordinary monopole antenna, and such an antenna impedance of the glass antenna 30 approximates to the characteristic impedance of a feeder line. This results in improved reception capability of the glass antenna 30.

Figure 9:
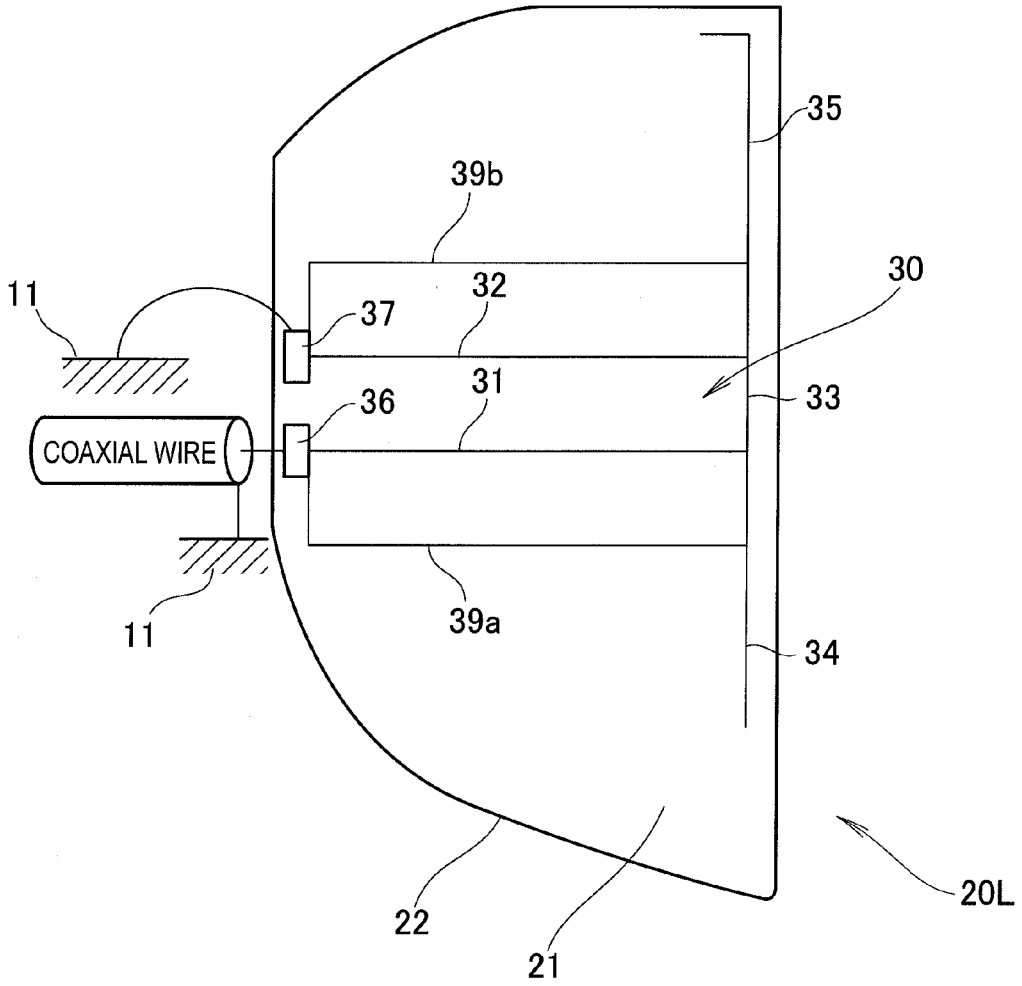
FIG. 9 is a view of a modification to the glass antenna in the embodiment.
Figure 13:
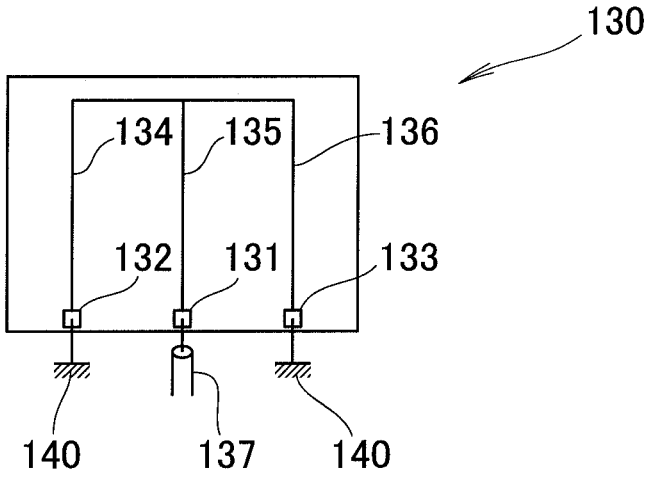
FIG. 13 is a view of a structure of a glass antenna in a third conventional example.

FIG. 9 shows a modification to the glass antenna 30. The modified glass antenna differs from the glass antenna 30 shown in FIG. 2 in that a first bypass antenna element 39*a* is added to the third antenna element 34 and a second bypass antenna element 39*b* is added to the third antenna element 35. The bypass antenna element 39*a* branches off from one end of the third antenna element 34 extending from the first antenna element 31 away from the second antenna element 32. The bypass antenna element 39*a* extends to the feed point 36. The second bypass antenna element 39*b* branches off from one end of the third antenna element 35 extending from the second antenna element 32 away from the first antenna element 31. The second bypass antenna element 39*b* extends to the ground point 37.

The modified glass antenna shown in FIG. 9 has an apparently large length due to the third antenna elements 34, 35, and provides a widened antenna pattern due to the first and second bypass antenna elements 39*a*, 39*b*. As a result, the reception sensitivity of the modified glass antenna is improved even when the modified glass antenna is mounted on the glass in the window of small opening area.

Figure 2:
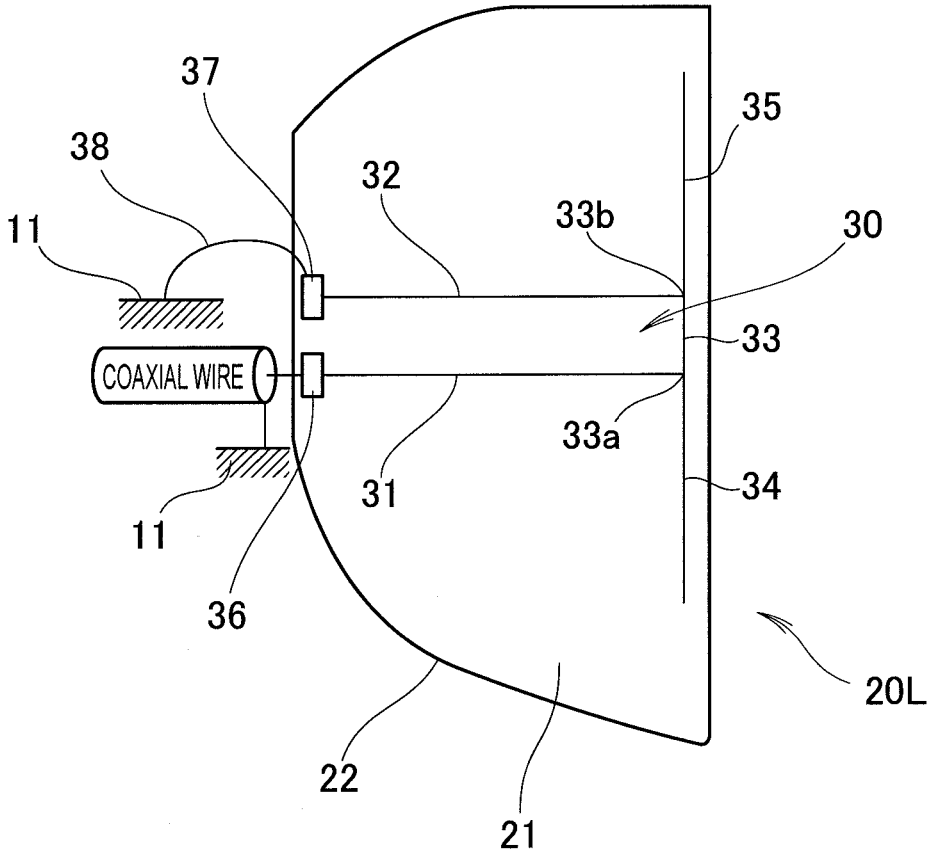
FIG. 2 is a view of a structure of the glass antenna in the embodiment.

FIG. 10 shows a further modification to the glass antenna shown in FIG. 2. Elements of the further modified glass antenna of FIG. 10 which correspond to those of the glass antenna of FIG. 2 are designated by the same reference numerals, and descriptions thereof are omitted. The further modified glass antenna of FIG. 10 differs from the glass antenna 30 of FIG. 2 in that the first and second antenna elements 31, 32 of the antenna of FIG. 10 extend vertically rather than horizontally.

In other words, the first antenna element 31 and the second antenna element 32 preferably extend in correspondence to a plane of polarization of a radio wave to be received. More specifically, the antenna elements extend in a horizontal direction to receive a horizontally polarized radio wave, as shown in FIG. 2, while the antenna elements extend in a vertical direction to receive a vertically polarized radio wave, as shown in FIG. 10. This means that the extension of the antenna elements of the antenna in correspondence to the plane of polarization improves a reception capability of the antenna.

In the embodiment of the present invention, the glass antenna 30 includes the additional third antenna elements 34, 35 as well as the linearly extending first antenna element 31 and the second antenna element 32 extending in the direction opposite the direction of extension of the first antenna element 31 and connected to the ground point 37 provided at the edge of the glass. The third antenna elements 34, 35 extend to the distal end of the first antenna element 31 and the proximal end of the second antenna element 32, respectively, along the opening portion of the vehicle body 11 (the circumference 22 of the quarter glass 21). Due to the third antenna elements 34, 35, the glass antenna 30 provides the apparently larger antenna element length without requiring additional terminals and feeder lines, and therefore the desired resonance frequency can be obtained even when the glass antenna 30 is mounted on a glass in small opening area. In addition, the antenna impedance of the glass antenna is greater than that of an ordinary monopole antenna and approximates to the characteristic impedance of a feeder line. This results in improved reception capability of the glass antenna.

In addition, the first antenna element 31 and the second antenna element 32 are extended in correspondence to the plane of polarization of a radio wave to be received. It is therefore possible to provide glass antennas for receiving radio waves providing a horizontal polarization and a vertical polarization. Further, the third antenna elements 34, 35 extend along the circumference of the quarter glass 21 with the interval of 50 mm between each of the third antenna element and the opposite edge of the glass. Due to the third antenna elements 34, 35, the antenna pattern can be apparently large, and reception capability of the glass antenna is improved. Furthermore, improved reception capability can be obtained because the ratio of each of the third antenna elements 34, 35 to each of the first antenna element 31 and the second antenna element 32 is 1.0 or less.

Moreover, the first and second bypass antenna elements 39*a*, 39*b* are added to the third antenna elements 34, 35, respectively. This means that addition of a bypass pattern is possible even when the glass antenna 30 is attached to a small surface area. The addition of the bypass pattern improves reception capability of the glass antenna.

It is noted that the third antenna elements 34, 35 may extend not linearly but be curved because the curved configuration provides the same advantageous results as long as the elements extend along the circumference 22 of the quarter glass 21. The third antenna elements can thereby be used in an opera window, vent window, or the like. In addition, the third antenna elements 34, 35 extend along the circumference 22 of the quarter glass 21, whereby free space is created in the center of the quarter glass 21. It is thus possible to consider using the free space for installation of, for example, a terrestrial digital TV receiver or other media antenna.

INDUSTRIAL APPLICABILITY

The glass antenna of the present invention provides remarkable advantageous results when the glass antenna is used on a vehicle lateral side window glass not limited to a quarter window but including an opera window, a vent window, or other windows required to have a comparatively small opening area.

REFERENCE SIGNS LIST

10: vehicle, 11: vehicle body, 20L: quarter window 21: quarter glass, 22: circumference, 30: glass antenna, 31: first antenna element, 32: second antenna element, 33: fold, 34, 35: third antenna elements, 36: feed point, 37: ground point, 38: connecting wire, 39*a*: first bypass antenna element, 39*b*: second bypass antenna element

The invention claimed is:

1. A glass antenna installed on a glass configured for attachment to an opening portion of a vehicle body, the glass having a first edge and a second edge opposite the first edge, the glass antenna comprising:

a first antenna element extending linearly from a feed point provided at the first edge of the glass toward the second edge of the glass;

a second antenna element folded and connected to a distal end of the first antenna element, the second antenna element extending in a direction opposite to a direction of extension of the first antenna element, the second antenna element being connected to a ground point provided at the first edge of the glass; and a pair of third antenna elements extending along the opening portion of the vehicle body to a distal end of the first antenna element and a proximal end of the second antenna element, respectively.

2. The glass antenna of claim 1, wherein the first antenna element and the second antenna element extend in correspondence to a plane of polarization of a radio wave to be received.

3. The glass antenna of claim 1, wherein each of the third antenna elements is spaced from the second edge of the glass by an interval of 50 mm or less.

4. The glass antenna of claim 1, wherein a ratio of a length of each of the third antennas elements to a length of each of the first antenna element and the second antenna element is 1.0 or less.

5. The glass antenna of claim 1, wherein one of the third antenna elements extends from the first antenna element away from the second antenna element, and the other of the third antenna element extends from the second antenna element away from the first antenna element; and wherein the glass antenna further comprises:

a first bypass antenna element branching off from an end portion of the one third antenna element and extending to the feed point; and a second bypass antenna element branching off from an end portion of the other third antenna element and extending to the ground point.

6. The glass antenna of claim 1; wherein the pair of third antenna elements extend along a circumference of the glass.

7. The glass antenna of claim 1; wherein the glass is a quarter glass; and wherein the pair of third antenna elements extend along a circumference of the quarter glass.

8. A glass antenna installed on a glass having a first edge and a second edge opposite the first edge, the glass antenna comprising:

a first antenna element extending linearly in a direction from the first edge to the second edge of the glass;

a second antenna element extending in a direction opposite to the direction of the first antenna and connected to a grounding point provided on the first edge of the glass; and a pair of third antenna elements intersecting a tip of the first antenna element and a base of the second antenna element, respectively, and extending along a circumference of the glass;

wherein the first antenna element extends linearly from a feed point provided at the first edge of the glass;

wherein at least one of the pair of third antenna elements has a first antenna section extending away from the second antenna element and a second antenna section extending away from the first antenna element; and further comprising a first bypass antenna element branching off from an end portion of the first antenna section and extending to the feed point, and a second bypass antenna element branching off from an end portion of the second antenna section and extending to the ground point.

9. The glass antenna of claim 8, wherein the first antenna element and the second antenna element extend in correspondence to a plane of polarization of a radio wave to be received.

10. The glass antenna of claim 8, wherein each of the pair of third antenna elements is spaced from the second edge of the glass by an interval of 50 mm or less.

11. The glass antenna of claim 8, wherein a ratio of a length of each of pair of third antenna elements to a length of each of the first antenna element and the second antenna element is 1.0 or less.

12. In combination with a glass mounted to an opening portion of a vehicle body, a glass antenna comprising:

a first antenna element extending linearly from a feed point provided at a first edge of the glass toward a second edge of the glass opposite the first edge;

a second antenna element connected to a distal end of the first antenna element and connected to a ground point provided at the first edge of the glass and connected to the vehicle body; and a pair of third antenna elements extending along the opening portion of the vehicle body and to the distal end of the first antenna element and a proximal end of the second antenna element, respectively.

13. The glass antenna of claim 12, wherein the first antenna element and the second antenna element extend in correspondence to a plane of polarization of a radio wave to be received.

14. The glass antenna of claim 12, wherein each of the third antenna elements is spaced from the second edge of the glass by an interval of 50 mm or less.

15. The glass antenna of claim 12, wherein a ratio of a length of each of the third antenna elements to a length of each of the first antenna element and the second antenna element is 1.0 or less.

16. The glass antenna of claim 12; wherein the pair of third antenna elements extend along a circumference of the glass.

* * * * *